US006758187B2

(12) United States Patent
Waters

(10) Patent No.: US 6,758,187 B2
(45) Date of Patent: Jul. 6, 2004

(54) METHOD AND APPARATUS TO ESTIMATE OIL AERATION IN AN ENGINE

(75) Inventor: James Patrick Waters, Waterford, MI (US)

(73) Assignee: Delphi Technologies, Inc., Troy, MI (US)

( * ) Notice: Subject to any disclaimer, the term of this patent is extended or adjusted under 35 U.S.C. 154(b) by 88 days.

(21) Appl. No.: 10/277,650

(22) Filed: Oct. 22, 2002

(65) Prior Publication Data

US 2004/0074469 A1 Apr. 22, 2004

(51) Int. Cl.[7] ..... F02B 77/00

(52) U.S. Cl. ..... 123/198 F; 123/90.16; 123/196 R

(58) Field of Search ..... 123/198 D, 198 F, 123/90.16, 196 R

(56) References Cited

U.S. PATENT DOCUMENTS 6,092,495 A * 7/2000 Hackett ..... 123/90.15
6,497,144 B1 12/2002 Lin
6,498,566 B1 12/2002 Lin
6,557,518 B1 * 5/2003 Albertson et al. ..... 123/198 F
6,584,942 B1 * 7/2003 Albertson et al. ..... 123/90.16
6,626,141 B2 * 9/2003 Choi ..... 123/196 R
6,647,935 B2 * 11/2003 Aoyama et al. ..... 123/90.16

* cited by examiner

*Primary Examiner*—Tony M. Argenbright
*Assistant Examiner*—Hyder Ali
(74) *Attorney, Agent, or Firm*—Jimmy L. Funke

(57) ABSTRACT

The present invention is a method and apparatus to determine an amount of aeration of fluids such as engine oil, thus permitting more aggressive operation of an oil-driven actuator, with fewer limitations in scheduling operation of the actuator. It includes monitoring engine speed and fluid temperature, and determining a first and second attitude of the engine relative to a first and second axis, and determines an amount of aeration of the fluid based upon those factors. The method determines an operating range of the fluid-driven actuator based upon the amount of aeration, and then permits the operation of the fluid-driven actuator within the operating range.

16 Claims, 2 Drawing Sheets

METHOD AND APPARATUS TO ESTIMATE OIL AERATION IN AN ENGINE

TECHNICAL FIELD

This invention pertains generally to internal combustion engine control systems, and more specifically to fluid-driven actuators on an engine.

BACKGROUND OF THE INVENTION

Engine manufacturers are incorporating systems with fluid-driven actuators, including actuators driven by engine lubricating oil pumped from an engine oil pump. Systems that include such actuators include variable cam phasing, cylinder deactivation, and variable valve lift and duration, among others. A system uses an oil control valve to divert flow of pressurized engine oil to drive the actuator to accomplish a desired work output. By way of example, an oil control valve used in conjunction with a variable cam phaser is used to accomplish variable opening time of an intake or exhaust valve, relative to a position of a reciprocating piston. The system uses the oil control valve to control the flow of engine oil to the variable cam phaser that is attached to a camshaft of the engine, based upon a command from an engine controller. Distinct engine performance benefits that are realized from the use of variable cam phasing include an improvement in combustion stability at idle, improved airflow into the engine over a range of engine operations corresponding to improvements in engine performance, and improved dilution tolerance. This results in such benefits as improved fuel economy, improved torque at low engine speeds, lower engine cost and improved quality through elimination of

TECHNICAL FIELD

This invention pertains generally to internal combustion engine control systems, and more specifically to fluid-driven actuators on an engine.

BACKGROUND OF THE INVENTION

Engine manufacturers are incorporating systems with fluid-driven actuators, including actuators driven by engine lubricating oil pumped from an engine oil pump. Systems that include such actuators include variable cam phasing, cylinder deactivation, and variable valve lift and duration, among others. A system uses an oil control valve to divert flow of pressurized engine oil to drive the actuator to accomplish a desired work output. By way of example, an oil control valve used in conjunction with a variable cam phaser is used to accomplish variable opening time of an intake or exhaust valve, relative to a position of a reciprocating piston. The system uses the oil control valve to control the flow of engine oil to the variable cam phaser that is attached to a camshaft of the engine, based upon a command from an engine controller. Distinct engine performance benefits that are realized from the use of variable cam phasing include an improvement in combustion stability at idle, improved airflow into the engine over a range of engine operations corresponding to improvements in engine performance, and improved dilution tolerance. This results in such benefits as improved fuel economy, improved torque at low engine speeds, lower engine cost and improved quality through elimination of external exhaust gas recirculation (EGR) systems, and improved control of engine exhaust emissions.

Performance of a fluid-driven actuator is reduced due to aeration of the fluid. The fluid is aerated by entrainment of air or by dissolving of air into the fluid. Dissolved and entrained air affects the physical properties of the fluid, including bulk modulus, or compressibility, and viscosity. When aerated fluid is pressurized, it increases in temperature at a greater rate than when not aerated. When the fluid is engine lubricating oil, this leads to reduction in oil lubricity and oil life. The aeration amount affects the performance of a pumping device to pump the fluid, in terms of pressure, flow and volumetric efficiency. It also affects the dynamic response of the pumping device. The amount of aeration also changes resonant frequency of the fluid, which affects response time and durability of a system that employs fluid to drive an actuator. There is a risk of increased of unacceptable noise levels and component-to-component interference when there is an unanticipated change in the dynamic response or resonant frequency of the system.

There are known engine operating characteristics that lead to aeration of the fluid. When the fluid is an engine lubricating oil, there is a sump in a crankcase of the engine. The engine lubricating oil is aerated as a result of rotating and reciprocating action of the crankshaft and piston rods into the sump and oil, and as a result of oil level in the sump being below a pump inlet pipe. The amount of aeration of the oil is measured and quantified for an engine that is operated under steady state operating conditions. The amount of aeration for a specific engine design is measured using a representative engine. This information is used by an engine control system to limit operation of the actuator, including implementation of algorithms that estimate an oil aeration amount based upon engine operation and time. In one example, an algorithm infers oil aeration by measuring an amount of time the engine spends within each of a number of engine speed ranges, including idle, off-idle to 1500 rpm, 1500–2000 rpm, and others. There are also algorithms that monitor both engine speed and engine temperature to determine oil aeration amount.

The engine control system uses information from an aeration algorithm to limit operation of the actuator, either by limiting the operating range or completely disabling the actuator when the oil aeration amount exceeds a threshold value. In either instance, the operator no longer derives any engine performance benefit from use of the actuator. A system that fails to employ some form of control based upon aeration of the oil risks loss of control of the actuator, which leads to degradation in functional performance and durability of the actuator and the base engine. Therefore, it is likely that a system designer will overestimate the amount of oil aeration, to protect the system and improve system and component durability. Again, the operator no longer derives any engine performance benefit from use of the actuator when it is disabled due to excessive oil aeration.

Each of these methods carries the disadvantage that it fails to account for a change in oil aeration amount associated with changes in attitude of the engine caused during dynamic operation. An engine in a vehicle experiences accelerations, decelerations, turning maneuvers, incline ascents and descents, and other actions that affect the fluid level and position in the sump, and therefore affect the interaction between the reciprocating parts of the engine and the oil. This action leads to more entrainment of air into the oil than was anticipated by the existing art, which compels a system designer to establish narrow actuator enable criteria.

SUMMARY OF THE INVENTION

The present invention provides an improvement over conventional engine controls that employ fluid-driven actuators in that it more accurately determines the amount of aeration of fluids such as engine oil, thus permitting more aggressive operation of the oil-driven actuator, with less limitations in scheduling operation of the actuator.

The present invention provides a method and a system for controlling a fluid-driven actuator used in an engine. This includes monitoring engine speed and fluid temperature, and determining a first and second attitude of the engine relative to a first and second axis. The invention then determines an amount of aeration of the fluid based upon those factors. The method determines an operating range of the fluid-driven actuator based upon the amount of aeration, and then permits the operation of the fluid-driven actuator within the operating range.

The present invention also encompasses monitoring an amount of agitation of the fluid directly, and determining the amount of aeration based upon the amount of agitation. The method then determines an operating range of the fluid-driven actuator based upon the amount of aeration, and allows operating the fluid-driven actuator within the operating range.

These and other objects of the invention will become apparent to those skilled in the art upon reading and understanding the following detailed description of the embodiments.

BRIEF DESCRIPTION OF THE DRAWINGS

The invention may take physical form in certain parts and arrangement of parts, the preferred embodiment of which will be described in detail and illustrated in the accompanying drawings which form a part hereof, and wherein.

DETAILED DESCRIPTION OF THE PREFERRED EMBODIMENT

Figure 1:
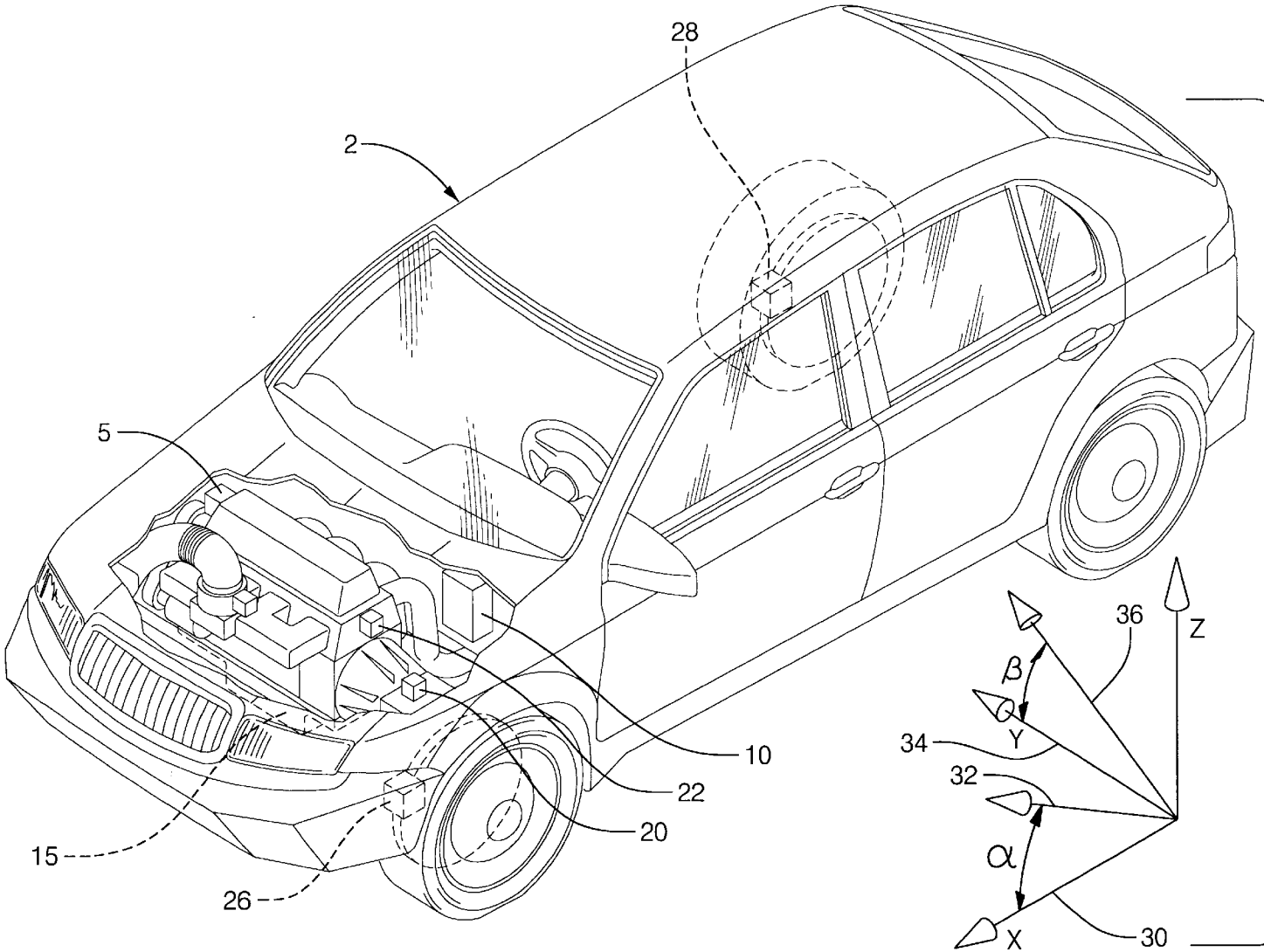
FIG. 1 is a block diagram, in accordance with the present invention.

Referring now to the drawings, wherein the showings are for the purpose of illustrating an embodiment of the invention only and not for the purpose of limiting the same, FIG. 1 shows a vehicle 2 with an internal combustion engine 5 and controller 10 which has been constructed in accordance with an embodiment of the present invention. The engine 5 includes an oil pump 12 that pumps oil from a sump 15 to lubricate various moving components within the engine 5, including for example, crankshaft, pistons, and camshafts (not shown). The oil from the oil pump 12 is pressurized and is diverted using a control valve 16 to drive a fluid-driven actuator 14, which is a cylinder deactivation device in this embodiment.

The engine 5 and controller 10 are mounted in a four-wheeled vehicle 2 in this embodiment. The controller 10 is operably connected to sensors that are used to monitor operation of the engine 5. The sensors may comprise an engine speed sensor 20, a coolant sensor 22, a manifold absolute pressure sensor, a throttle position sensor, an oxygen sensor, intake air temperature sensor, mass air flow sensor, EGR position sensor, exhaust pressure sensor, exhaust gas sensor, torque sensor, combustion sensor, among others (not shown). The controller 10 is also operably connected to sensors that are used to monitor operation of the vehicle 2, and may comprise a vehicle speed sensor 24, at least one wheel speed sensor 26 on each side of the vehicle 2, a fuel tank level sensor (not shown), among others. The controller 10 is also operably connected to output devices that are used to control operation of the engine 5, including the cylinder deactivation device 14, ignition system, fuel system, exhaust gas recirculation system, (not shown) and others. The controller 10 operates by collecting information from the sensors (not shown) and controlling the output systems (not shown), including the fluid-driven actuator 14, using control algorithms and calibrations internal to the controller 10. The operation and control of the engine 5 and vehicle 2 using the controller 10 with control algorithms and calibrations is known to one skilled in the art.

There is a first attitude 32 of the fluid in the sump 15 of the engine 5 in the vehicle 2 relative to a first axis 30, and a second attitude 36 of the fluid in the sump 15 of the engine 5 relative to a second axis 34. The first axis 30 is defined to be parallel to a longitudinal axis of the vehicle 2, and is fixed relative to earth. The second axis 34 is lateral, and defined to be perpendicular to the longitudinal axis of the vehicle 2, parallel to a horizontal surface, and fixed relative to earth. The first attitude 32 is a measure of the vertical movement of the fluid in the sump 15 of the engine 5 relative to the first axis 30. This happens during vehicle acceleration or braking, or when the vehicle 2 is ascending or descending an incline. The second attitude 36 is a measure of the vertical movement of the fluid in the sump 15 of the engine 5 relative to the second axis 34, as happens during vehicle cornering maneuvers, or when the vehicle 2 is inclined laterally. The first attitude 32 is determined by measuring vehicle speed using information from at least one of the vehicle speed sensors 26, 28 and calculating a longitudinal acceleration value that is based upon the vehicle speed. The second attitude 36 is determined by measuring a relative wheel speed on each side of the vehicle 2, using the wheel speed sensors 26, 28 on each side of the vehicle 2, and calculating a lateral acceleration value that is based upon the relative wheel speed. The determination of longitudinal and lateral acceleration values is well known to one skilled in the art.

Figure 2:
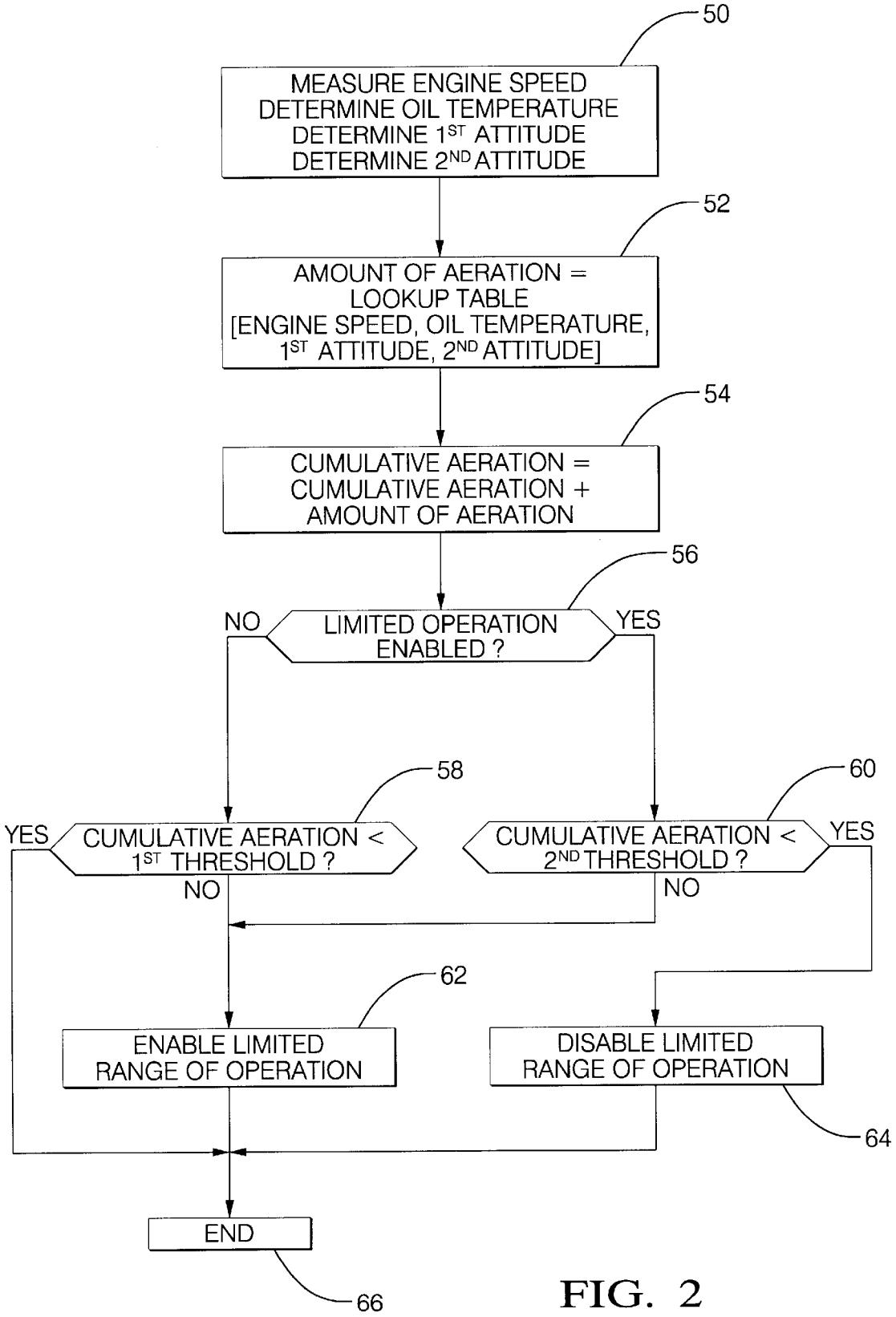
FIG. 2 is a flowchart, in accordance with the present invention.

Referring now to FIG. 2, the invention comprises a method for controlling the cylinder deactivation device 14 used in the engine 5. The method is executed using algorithms and accompanying calibrations that are contained in the controller 10. The method determines an amount of aeration using an algorithm that is executed every 100 milliseconds of engine operation. An amount of aeration at engine startup is initialized to a value of zero.

As shown in block 50, the method includes monitoring engine speed, preferably using the engine speed sensor 20. The method also includes determining a temperature of the fluid, in this case the engine oil. The controller 10 determines engine oil temperature based upon the coolant temperature as measured by the coolant sensor 22, and other operating conditions. The other operating conditions include an amount of time that has elapsed since the engine 5 was last operating, an amount of time that the engine 5 has been operating, speed and load of the engine 5 during the operating time, and an initial temperature of the engine 5 at startup. Determining engine oil temperature is known to one skilled in the art. The first attitude 32 and the second attitude 36 are then determined, as described earlier.

As shown in block 52, an amount of aeration of the fluid is then determined by the controller 10 based upon the engine speed, the oil temperature, the first attitude 32, and the second attitude 36. The amount of aeration is a pre-calibrated value that is determined for a specific engine design over a range of operating conditions related to the speed of the engine, the temperature of the fluid, the first attitude and the second attitude. The amount of aeration for each operating condition is determined by testing representative engines during engine development, and employing an oil density meter that is operable to continuously measure oil density and temperature. For example, the oil density meter can be a Micromotion™ Massflow meter, which is operable to instantaneously measure a percentage of oil aeration, based upon a change in density.

A designed experiment is created using the engine operating factors of engine speed, oil temperature, first attitude, and second attitude. Test conditions comprised of preset values for the engine operating factors are determined based upon the designed experiment. The engine is operated at each of the predetermined test conditions and the density of the oil is measured. The measured density of the oil is normalized, based upon the baseline curve of density as measured for the oil at the specific oil temperature. After the density of the oil has been normalized, any change in density of the oil is attributed to a change in aeration of the oil. This is expressed as a percentage of aeration.

The representative engine is operated at each test condition, and a rate of aeration and a steady state amount of aeration of the oil are measured. The engine speed test conditions will range from idle to maximum engine speed. Test conditions for oil temperature will typically range from 20 C to 100 C, with most of the focus on the range of 80 C to 100 C. The first and second attitudes are tested over a range from 0 to 1 g of acceleration force. A useful factor in determining a representative first attitude or second attitude is that 1 g of acceleration represents a 45° rotation of the engine in a test dynamometer setup.

By way of example, a typical cylinder deactivation system may be scheduled to operate over a range of engine speeds from idle to 3000 rpm, when the engine oil temperature is warmed up, which is about 90° C. A calibrator will reduce the measured rate of aeration and steady state amount of aeration of the fluid to an array of reference values of aeration. The array of reference values of aeration represents the amount of aeration that occurs during 100 milliseconds of engine operation, based upon monitored operating conditions. The results of the designed experiment, in the form of the array of reference values of oil aeration, are used to create a calibration array that is stored in the controller 10 as either a series of equations or as lookup tables. Designed experiments and the creation of calibration arrays for use in engine controllers are well known to those skilled in the art.

As shown in block 54, a new cumulative aeration value is determined by adding the amount of aeration determined in block 52 to an existing cumulative aeration value. The amount of aeration is determined during each 100 milliseconds of engine operation, and the new cumulative value of aeration is stored in the controller 10. The reference value of aeration determined in block is 52 can be a net increase or a net decrease, and is either added to or subtracted from the cumulative value of aeration.

As shown in block 56, the controller 10 determines if a limited range of operation of the output device has been enabled. If the limited range of operation has not been enabled, the controller determines if the cumulative value of aeration exceeds a first predetermined threshold (block 58). When the cumulative value of aeration does not exceed the first predetermined threshold, the 100-millisecond execution of the algorithm (block 66) ends without further action. When the cumulative value of aeration exceeds the first predetermined threshold, the controller 10 enables the limited range of operation of the output device in subsequent operations (block 62), and the method ends (block 66). If the limited range of operation of the output device has not been enabled, the controller 10 determines if the cumulative value of aeration is less than a second predetermined threshold (block 60). When the cumulative value of aeration is less than the second predetermined threshold, the method disables the limited range of operation of the output device in subsequent operations (block 64) and the algorithm ends (block 66). When the cumulative value of aeration is not less than the second predetermined threshold, the method will continue to enable the limited range of operation of the output device in subsequent operations (block 62) and the method will end (block 66). When the engine 5 and controller 10 are using the cylinder deactivation device 14, the cylinder deactivation device will be completely disabled outside the range of operation. A typical value for the normal range of operation for the cylinder deactivation system 14 is an operating engine speed range between idle and 3000 rpm. A typical value for the limited range of operation for the cylinder deactivation system 14 is an operating engine speed range between idle and 2000 rpm.

The first and second predetermined thresholds for the cumulative value of aeration are determined during vehicle development, and are specific to engine design and actuator applications. The first predetermined threshold is a level of aeration at which the functional performance of the cylinder deactivation device 14 degrades unacceptably, and will include an assessment of risks related to short-term performance objectives and long-term durability of the system. The second predetermined threshold is set at a value below the first predetermined threshold so as to allow for hysteresis in the operation of the system.

Although this is described as a system and method for controlling the cylinder deactivation device 14 used in the engine 5, it is understood that embodiments of this invention include all actuators that are driven by engine oil. These include, for example, valve deactivation devices, variable cam phasing devices, variable valve timing devices, and two step valve control devices. The invention also includes any application of the invention onto vehicles other than four wheel vehicles, including for example, trucks, boats, ships, motorcycles, farm tractors, and construction equipment. The invention also includes applications on diesel or spark-ignition engines. The invention also includes all applications wherein the amount of aeration is determined at a regular interval, including for example, when such an interval is determined by elapsed time, operating time, or quantity of engine rotations, and other loop cycles in addition to the 100 millisecond loop mentioned in the embodiment.

It is also understood that the invention includes other methods and devices to determine the first attitude 32 and the second attitude 36, including for example, monitoring changes in fluid level of a vehicle fuel tank (not shown) using a fuel level sensor (not shown), or wherein there is a direct measure of the fluid level in the sump 15. The invention also includes other methods of determining a change in lateral or longitudinal acceleration, such as sensing method to directly determine the g forces. It is also understood that the invention includes a system that can monitor a level of agitation of the fluid in the sump 15.

The range of operation of the actuator 14 is described as being either full range or a limited operating range. The invention also includes a system wherein there is at least one intermediate range, such as would allow a range of operation that is less than the full range. The invention also includes other methods and devices to determine temperature of the engine oil or other fluid, including for example an oil temperature sensor or an oil quality sensor with temperature measuring capability, or other methods of temperature estimation.

The amount of aeration at engine startup is initialized to a value of zero, but it is also understood that the startup aeration can be determined based upon a previous operating cycle and an amount of time the engine has been shutdown.

It is also understood that the engine oil temperature may be derived by the controller 10, using input from an oil pressure sensor (not shown). Engine oil temperature may also be directly measured, using input from an oil temperature sensor (not shown) or an oil condition sensor (not shown) that are connected to the controller 10.

The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. A method for controlling a fluid-driven actuator used in an engine, comprising:

monitoring a speed of the engine, determining a temperature of the fluid, determining an attitude of the engine; and determining an amount of aeration of the fluid based upon the speed of the engine, the temperature of the fluid, and the attitude of the engine.

2. The method of claim 1, further comprising determining an operating range of the fluid-driven actuator based upon the amount of aeration of the fluid, and controlling the fluid-driven actuator such that it functions within the operating range.

3. The method of claim 2, wherein determining an amount of aeration, of the fluid based upon the speed of the engine, the temperature of the fluid, and the attitude of the engine occurs at regular intervals during engine operation.

4. The method of claim 2, wherein the engine is mounted in a vehicle.

5. The method of claim 1, wherein determining the attitude of the engine comprises determining a first attitude of the engine relative to an axis parallel to a longitudinal axis of the vehicle; and determining a second attitude of the engine relative to a second axis perpendicular to the longitudinal axis of the vehicle and parallel to a horizontal surface.

6. The method of claim 5, wherein determining the first attitude of the engine relative to the first axis comprises determining a longitudinal acceleration of the vehicle.

7. The method of claim 5, wherein determining the second attitude of the engine relative to a second axis comprises determining a lateral acceleration of the vehicle.

8. The method of claim 1, wherein determining the amount of aeration of the fluid based upon the speed of the engine, the temperature of the fluid, and the attitude of the engine comprises:

operating a representative engine at at least one preset value for the speed of the engine, the temperature of the fluid, and the attitude of the engine;

measuring a reference rate of aeration and steady state amount of aeration of the fluid in the representative engine at each of the at least one preset value for the speed of the engine, the temperature of the fluid, and the attitude of the engine;

generating a calibration array based upon the reference rate of aeration and steady state amount of aeration of the fluid in the representative engine at each of the at least one preset value for the speed of the engine, the temperature of the fluid, and the attitude of the engine; and selecting a value from the calibration array based upon the speed of the engine, the temperature of the fluid, and the attitude of the engine.

9. A control system for an fluid-driven actuator on an engine comprising:

a controller comprised of an internal calibration and algorithm;

said controller operably attached to at least one sensor, such that the controller is operable to determine:

a speed of the engine, a temperature of the fluid, an attitude of said engine, based upon the at least one sensor;

wherein said controller uses the internal calibration and algorithm to determine an amount of aeration of the fluid, based upon the speed of the engine, the temperature of the fluid, and the attitude of the engine; and wherein the controller controls the fluid-driven actuator based upon the amount of aeration of the fluid.

10. The control system of claim 9, wherein the control system determines an operating range of the fluid-driven actuator based upon the amount of aeration of the fluid.

11. The control system of claim 10, wherein the control system operates the fluid-driven actuator such that it functions within the operating range.

12. The control system of claim 10, wherein the fluid-driven actuator comprises a variable cam phaser system.

13. The control system of claim 10, wherein the fluid-driven actuator comprises a cylinder deactivation system.

14. A method for controlling a fluid-driven actuator, comprising:

providing a pumping device that includes a fluid sump for supplying fluid to the actuator;

monitoring an amount of agitation of the fluid;

determining a temperature of the fluid;

determining an attitude of the fluid sump;

determining an amount of aeration of the fluid based upon the amount of agitation of the fluid, the temperature of the fluid, and the attitude of the engine, determining an operating range of the fluid-driven actuator based upon the amount of aeration of the fluid, and controlling the fluid-driven actuator such that it functions within the operating range.

15. A method for controlling a fluid-driven actuator, comprising:

providing a pumping device that includes a fluid sump for supplying fluid to the actuator;

monitoring an amount of agitation of the fluid in the fluid sump;

determining an amount of aeration of the fluid based upon the amount of agitation of the fluid;

determining an operating range of the fluid-driven actuator based upon the amount of aeration of the fluid, and controlling the fluid-driven actuator such that it functions within the operating range.

16. A method for determining a measure of aeration of engine oil in a motor vehicle, the improvement comprising monitoring a speed of the engine, determining a temperature of the fluid, determining an attitude of the engine, based upon a longitudinal acceleration of the vehicle and a lateral acceleration of the vehicle; and determining an amount of aeration of the fluid based upon the speed of the engine, the temperature of the fluid, and the attitude of the engine.

* * * * *